United States Patent [19]

Hanser et al.

[11] Patent Number: 4,869,174

[45] Date of Patent: Sep. 26, 1989

[54] EXERCISE FIRING PROJECTILE

[75] Inventors: Walter Hanser, Bad Krozingen; Peter Rayer, Neuenburg/Baden; Norbert Wardecki, Glottertal; Peter Hug, Zehningen, all of Fed. Rep. of Germany

[73] Assignee: Buck Werke GmbH, & Co., Bad überkingen, Fed. Rep. of Germany

[21] Appl. No.: 327,031

[22] Filed: Mar. 22, 1989

[51] Int. Cl.[4] ..... F42B 13/50

[52] U.S. Cl. ..... 102/489; 102/334; 102/340; 102/498; 102/529; 102/513

[58] Field of Search ..... 102/334, 340, 342, 351, 102/357, 393, 395, 476, 489, 498, 513, 529

[56] References Cited

U.S. PATENT DOCUMENTS

| | | | |
|---|---|---|---|
| 1,011,002 | 12/1911 | Wunshe | 102/340 |
| 1,090,007 | 3/1914 | Ziegenfuss | 102/340 |
| 3,491,689 | 1/1970 | Francois | 102/340 |
| 4,078,954 | 3/1978 | Bernardy | 149/198 |
| 4,324,183 | 4/1982 | Prahauser et al. | 102/334 |
| 4,558,645 | 12/1985 | Boedu et al. | 102/489 |
| 4,651,648 | 3/1987 | Alon | 102/334 |
| 4,793,260 | 12/1988 | Kruse et al. | 102/489 |

*Primary Examiner*—Harold J. Tudor

*Attorney, Agent, or Firm*—Watson, Cole, Grindle & Watson

[57] ABSTRACT

An exercise firing projectile containing a plurality of pyrotechnic fragmentation devices are expelled from the projectile casing above the target area by an ejection charge, and delay tubes of the fragmentation devices are ignited at the same time by this charge through a central igniter tube contained within the projectile. The active charge of the devices consist of a grainy composite with quick reaction time.

11 Claims, 5 Drawing Sheets

EXERCISE FIRING PROJECTILE

BACKGROUND OF THE INVENTION

This invention relates generally to an exercise firing projectile having an elongated casing with a rupturable cap at one end, a coaxial hollow tube within the casing extending toward the cap, the tube defining an annular space with the inner wall of the casing. Clusters of stacked pyrotechnic fragmentation devices are located in the such annular space, and the casing contains an ejection charge which, when ignited, effects rupture of the cap allowing the devices to be expelled from the one end of the projectile casing.

Firing projectiles containing such framentation devices, oir bomblets, are used primarily to defend against armored vehicles. The projectile is fired by a gun or missile to a point that is, for example, 300 to 400 meters above the target at which point an ejection charge ejects or releases about 50 to 90 bomblets from the projectile casing. The bomblets then drop to the ground individually and dispurse over an area of about 50 to 100 meters. The bomblets contain a shaped charge and a percussion fuse, so that they ignite when impacting, for example, an armored vehicle to thereby pierce the armor plate.

The testing of such firing projectiles is presently carried out by removing either the percussion fuse or the shaped charge from the bomblets. While this permits safe testing of, for example, the effectiveness of the ejected charge as well s the functioning of the percussion fuses and similar components, it prevents exercises from approximating live situations, since the functional characteristics of a detonation cloud, a flash of light and an explosive sound are missing and since, moreover, safe handling is made difficult if the explosive is to be tested.

SUMMARY OF THE INVENTION

It is therefore an object of the present invention to avoid the aforementioned problems by the provision of an exercise firing projectile which enables exercises to be carried out as realistic as possible while still being safe and as economic as possible. Specifically, each of the fragmentation devices, or bomblets, comprises the casing having an active charge, an ignitor and a stored, collapsed stabilizer, the active charge comprising a pyrotechnic composite of nitrocellulose, magnesium and a medium. The igniter comprises a delay unit ignitable by the ejection charge through bores located in the central tube.

The use of a pyrotechnic charge makes it possible to simulate the sound and flash which resemble that of live bomblets, and results in an image that resembles a ground hit and produces optical impact markings which are visible over long distances. Moreover, through soil displacement and combustion residue, a dispersion cloud is created which to a considerable degree corresponds to one created by live ammunition, and which makes it possible to visually perceive bomblet hits and, consequently, their distribution in the target area. The ignition of this pyrotechnic charge is triggered by a delay unit which is ignited when the bomblet is ejected from the projectile and which has a time delay capability which exceeds the time of descent of the bomblets. This greatly enhances safety when duds are recovered as compared to live ammunition because, contrary to percussion fuses, the malfunctioning delay mechanism cannot be activated by mechanical impacts or by other means. Therefore recovery of bomblets, or bomblet fragments, which is required in the target area during exercises, presents absolutely no danger even if duds are present. A delay unit is, moreover, considerably more cost-effective than the percussion fuse which for live ammunition must be connected to a complicated safety system. The ignition of the delay unit occurs when the bomblets are ejected from the projectile and is triggered by the existing ejection charge which also serves as the ignition charge. In this process the distribution of the ignition flame to the individual bomblets occurs through the central inner tube within the projectile. Such tube also functions to aid in immobilizing the bomblets against movements within the projectile casing, so that simple and inexpensive projectile casings of corresponding caliber can be utilized without the need for special and considerably more, expensive live ammunition casings which are equipped with interiior ribs.

BRIEF DESCRIPTION OF THE DRAWINGS

The drawings illustrate, and the appended claims define, particularly appropriate designs of the invention with regard to the pyrotechnic charge, the design and arrangement of the delay unit in the bomblets, the arrangement of the bomblets in the projectile casing and the design of the central interior tube.

Figure 1:
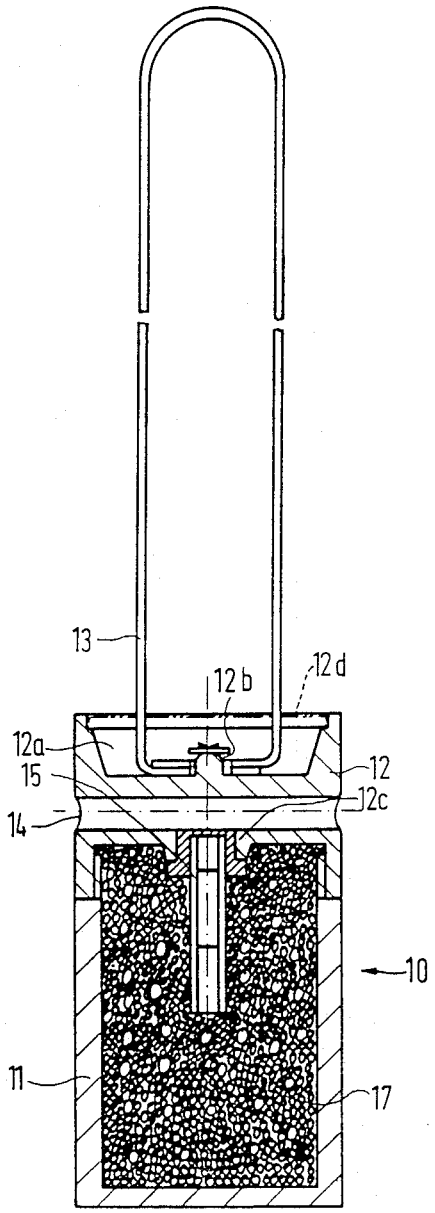
FIG. 1 is a longitudinal sectional view of a fragmentation device, or bomblet, according to the invention.

The fragmentation device, or bomblet, generally designated 10 in FIG. 1, has a cup-shaped casing 11 closed by a lid 12. The outer end of the lid has an outwardly open recess **12*a* in which a pin 12*b* is located for the attachment of a conventional stabilizer strip 13. And, the lid has a transverse igniter hole 14 open at opposite ends. A thin cup-shaped element 12*c* extends from the lid toward the interior of casing 11 and serves to mount a small delay tube 15**.

Figure 1A:
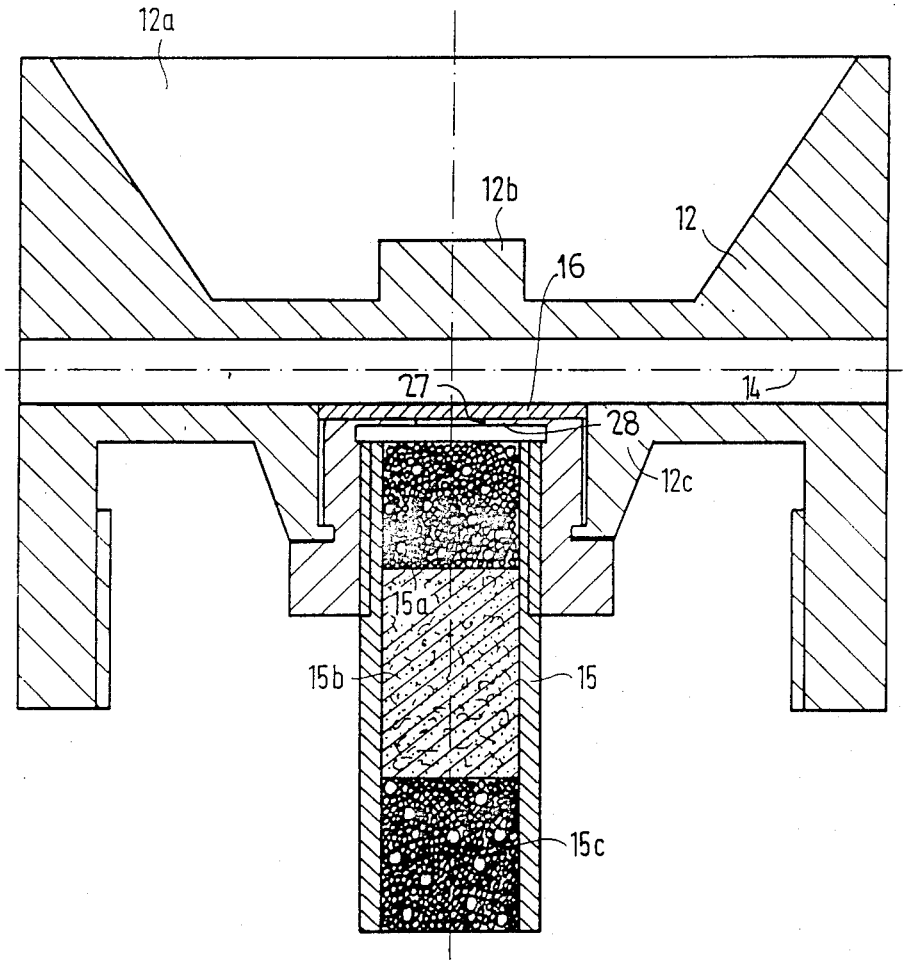
FIG. 1A is a partial cross-section of FIG. 1 shown at a larger scale.

As best seen in FIG. 1A, delay tube 15 comprises, as usual, a primer **15*a*, a delay-action charge 15*b* and a firing charge 15*c*. The ignition side of the tube 15, toward ignition bore 14, is covered by a foil 16 which may be of aluminum. And, there is a small gap of, for example, 1.75 mm between the end surface of primer 15*a* and the overlying foil 16**, the purpose of this gap to be explained in detail hereinafter.

The active charge of bomblet 10 is designated 17 in FIG. 1 and consists of a pyrotechnic flashing and an explosive sound-producing substance. The pyrotechnic charge 17 consists of large-grained nitrocellulose (NC) and magnesium powder. A suitable medium assures that the magnesium powder adheres to the surface of the NC grains (which may, for example, be shaped as small rods) in such a way that each NC grain has a coating of magnesium powder which thereby precludes segregation.

Figure 2:
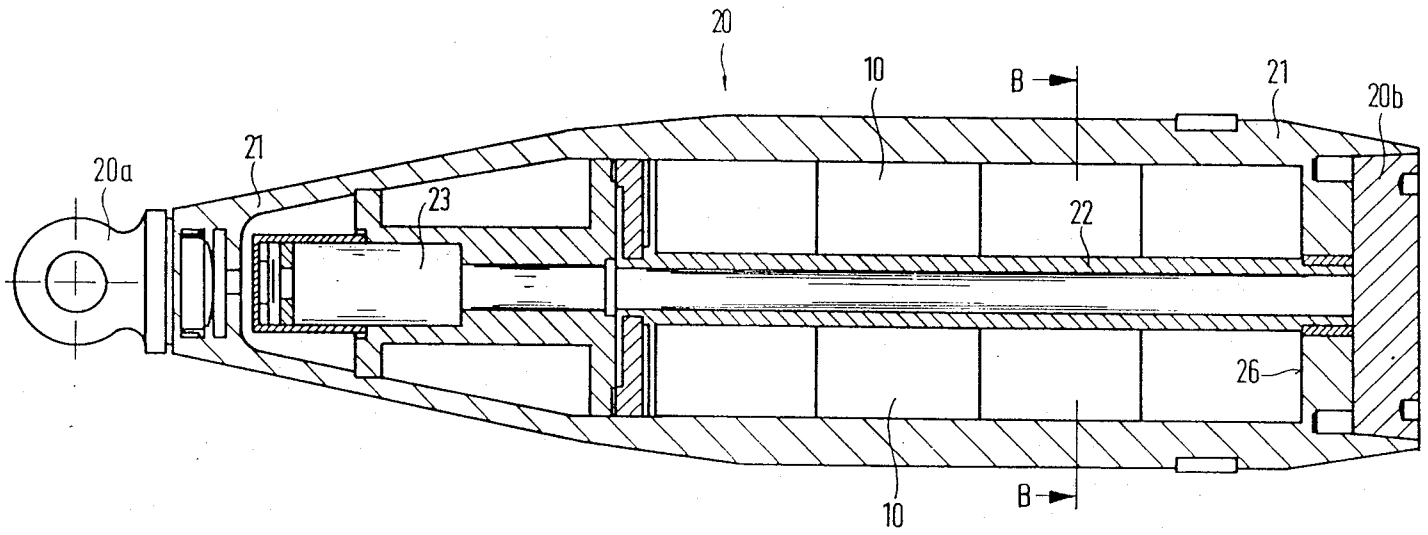
FIG. 2 is a longitudinal sectional view of a firing projectile containing the bomblets of FIG. 1 shown at a reduced scale.
Figure 2A:
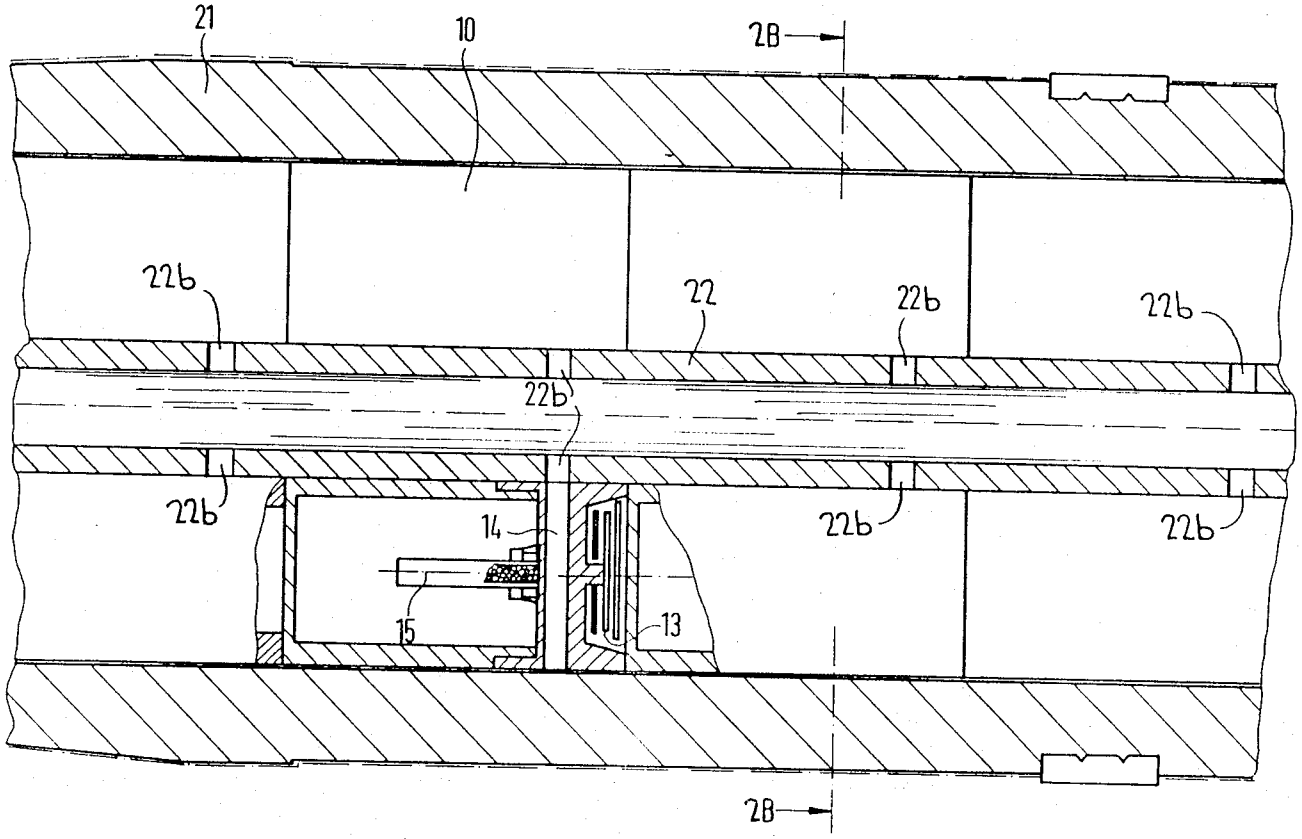
FIG. 2A is a partial sectional view of FIG. 2 shown at a larger scale.
Figure 2B:
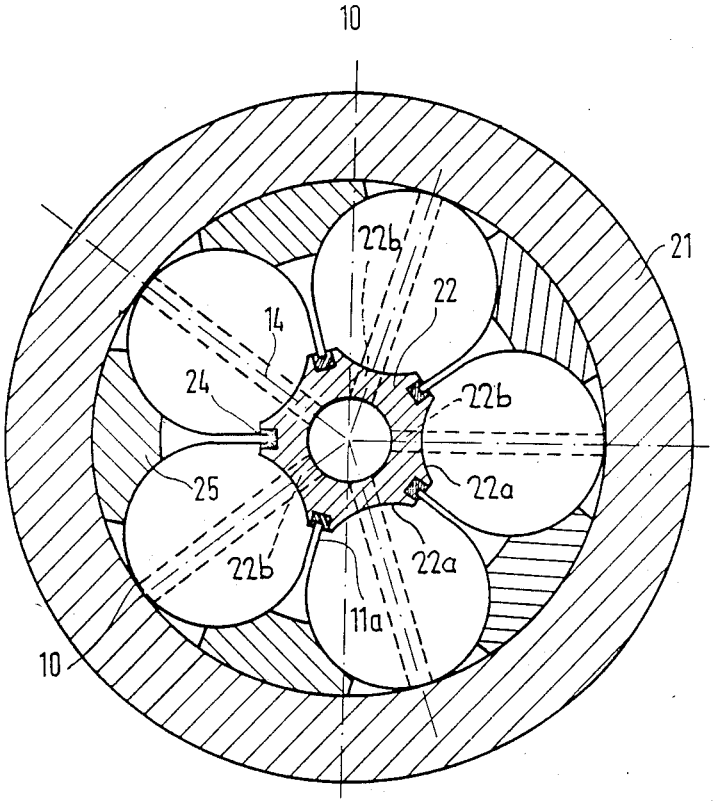
FIG. 2B is a cross-sectional view taken substantially along the line 2B—2B of FIG. 2A.

FIGS. 2, 2A and 2B illustrate a firing projectile generally designated 20 and comprising a casing 21 which contains a number of bomblets 10. In the example shown the bomblet batch comprises four layers, stacked on top of one another, of five bomblets each, evenly distributed about the longitudinal axis of the projectile, for a total of 20 bomblets. The projectile has a coaxial, hollow ignitor tube 22 within casing 21, the tube extending at one end toward tip 20*a* of the projectile and communicating with an ejection-ignitor charge 23. The opposite end of the tube extends toward a rupturable cap 20*b* at the base of the projectile.

As more clearly shown in FIG. 2B, the stacked clusters of bomblets 10 are located in an annular space defined between the inner wall of casing 21 and tube 22. Devices 10 are substantially cylindrical, and ignitor tube 22 has external, longitudinal, arcuate grooves 22*a* in which bomblets 10 are nested. With such an arrangement, the devices 10 are immobilized against movement within casing 21, i.e., against rotational movement iof devices 10 about the central axis of tube 22 as well as against radial movement of the bomblets within the annular space. And, each of the devices 10 has a pair of external projections 11*a* respectively on opposite sides and equidistant from transverse bore 14 thereof, projections 11*a* engaging longitudinal flat surfaces located between pairs of grooves 22*a* for radially orienting transverse bore 14 relative to tube 22. Hardened damping ribs 24 define the flat surfaces between pairs of grooves 22*a* which are engaged by projections 11*a*. This assures that bomblets 10 are mounted within projectile casing 21 free of rattles and vibrations, and moreover immobilizes the bomblets against rotation about their respective central axes.

It is of critical importance that bomblets 10 be oriented by casing projections 11*a* such that their ignition bores 14 extend radially within the projectile with the inner end of each ignition bore 14 adjoining ignitor tube 22 and the outer end of each ignition bore 14 adjoining the inner wall of casing 22. As shown in FIGS. 2A and 2B, tube 22 has radially extending bores 22*b* respectively in alignment with bores 14 for establishing open communication between the interior of tube 22 and ignition bores 14 of bomblets 10.

Although the outer ends of transverse bores 14 adjoin the inner wall of casing 21, the outer openings of bores 14 are not completely closed since the curvature of casings 11 of the bomblets is greater than the curvature of projectile casing 21 having a larger diameter.

Trapezoidal filler units 25 are shaped to conform to the inner wall casing 21 and to adjacent pairs of devices 10. Some of the filler units may be of aluminum, or plastic material, and some others may be of steel. By selecting the arrangement and number of heavy steel filler units the weight and center of gravity of the entire projectile may be adjusted.

A ring 26 (FIG. 2) serves to cover the lids 12 of the bomblets that are immediately underlying this ring, and thus provides additional protection of stabilizer strips 13 of such bomblet layer, which are otherwise covered by detachable cardboard or plastic discs 12*d*.

The aforedescribed projectile functions as follows. The exercise firing projectile, just like live ammunition, is fired from a launcher tube and, when the projectile is above the target area, a delay fuse (not shown) ignites the ejection and igniter charge 23. This triggers two processes. First, an ignition stream of charge 23 fills igniter tube 22, penetrates through igniter bores 22*b* and into ignition bores 14 of the bomblets, pierces cover foil 16 and ignites primer 15*a* of the small igniter tubes 15. Second, because of the ignited charge 23 so much gas pressure accumulates in the projectile that it causes the projectile bottom 20*b* as well as ring 26 to rupture such that the bomblets are expelled from the projectile casing which is now open at its rearward end. As to the ignition of delay tube 15 of each bomblet it is particularly important that the ignition stream, which travels through igniter tube 22 from front to rear, changes direction twice by 90 degrees, for a total of 180 degrees, before it reaches each ignition charge 15*b* of small delay tube 15. In other words, the ignition stream proceeds radially outwardly at 90 degrees through bores 22*b*, and thereafter proceeds in longitudinal directions for igniting the delay tubes. In the course of such travel the ignition stream loses some of its force, so that there is no danger that the delay tubes 15 are ruptured and/or that an immediate ignition of active charge 17 thereof occurs. The aforementioned partial covering of the outer ends of ignition bores 14 thus causes a backup within bores 14, which assures a safe diversion of the ignition stream in the direction of delay tubes 15. In any event, the aforementioned small gap between aluminum foil 16 and primer 15*a* assures a safe piercing of foil 16. If there were no such gap, primer 15*a* would act as an abutment for foil 16, so that the foil would not be pierced. If the gap were too large, the foil would be pierced but it would no longer assure that the ignition stream would reach and ignite primer 15*a*. And, the diameter of igniter bore 27 is smaller by about 1 to 2 mm than the bore of delay tube 15 containing primer 15*a* and covered by the foil. This diameter difference presents a shoulder 28 which prevents the burning material of the primer from leaking out when the bomblet is, for example, lying on its side.

The described interplay of the diversion of the ignition stream of the ejection and ignition charge 23 by 180 degrees of the initiation of a backup in igniter bore 14, of the preservation of a small gap between foil 16 and the surface of primer 15*a*, and of the ignition shoulder 28 assures problem-free ignition and a properly functioning of delay tubes 15 without danger of rupturing the delay tubes.

Bomblets 10, now expelled from projectile casing 21, fall to the ground through gravity, while stabilizer strips 13 in recesses 12*a* of the lids unfold and support the appropriate vertical fall of the bomblets. The bomblets hit the ground one after another in succession within about 1 and ½ seconds. The time delay of small delay tubes 15 is calculated in such a way that its firing charge 15*c* ignites the pyrotechnic charge 17 shortly after the bomblets hit the ground. This results in a flash and an explosive sound similar to that of live ammunition. In addition, the dispersion cloud created by displaced soil and combustion residue corresponds largely to that created by live ammunition. In this context it is important that the bomblets hit the ground with the bottoms of their casings and not with their lids. This is assured by the provision of stabilizer strips 13. Bomblet residue, as well as possible duds, can be thereafter collected with absolute safety. The aforedescribed exercise firing projectile provides excellent simulation of live ammunition and is not dangerous. Moreover, it can be produced economically primarily because expensive ignition safety devices are not required and because simple projectile casings suffice instead of the complicated projectile casings required for live ammunition.

From the foregoing it can be seen that many other modifications and variations of the invention are made possible in the light of the above teachings. For example, the number of bomblets contained within the projectile may vary as well as the corresponding external shape of the igniter tube. The bomblet covers may vary in design, with or without stabilizer strips which can be replaced by cardboard discs or the like, and the composition of the pyrotechnic charge may differ from that described, without departing from the invention. It is therefore to be understood that within the scope of the appended claims the invention may be practiced otherwise than as specifically described.

What is claimed is:

1. An exercise firing projectile having an elongated hollow casing with a rupturable cap at one end, a coaxial hollow tube within said casing extending toward said cap, said tube defining an annular space with the inner wall of said casing, clusters of stacked pyrotechnic fragmentation devices located in said annular space, said casing containing an ejection charge which, when ignited, effects rupture of said cap allowing said devices to be expelled from said one end, each of said devices comprising a casing containing an active charge, an igniter and a stored collapsed stabilizer, said active charge comprising a pyrotechnic composite of nitrocellulose, magnesium and a medium, said igniter comprising a delay unit ignitable by the ejection charge through bores located in said tube.

2. The projectile according to claim 1, wherein the nitrocellulose is coarse-grained, the magnesium is a powder covering the grains, and the medium is a coating for adhering the powder to the grains.

3. The projectile according to claim 1, wherein said casing of each said device is cup-shaped and has a covering lid, said delay unit being secured to said lid and extending into said active charge, and said lid having a transverse bore open at opposite ends and communicating with said delay unit and with one of said bores in said tube.

4. The projectile according to claim 3, wherein a cover of aluminum foil overlies said delay unit adjacent said transverse bore, said delay unit containing a primer spaced slightly beneath said foil.

5. The projectile according to claim 3, wherein said lid has an outwardly open recess for the reception of said collapsed stabilizer.

6. The projectile according to claim 5, wherein said recess is covered by a detachable disc.

7. The projectile according to claim 3, wherein means are provided in said annular space for immobilizing said devices against movement within said hollow casing.

8. The projectile according to claim 7, wherein said casing of each said device is substantially cylindrical, said tube having external, longitudinal arcuate grooves in which said devices are nested.

9. The projectile according to claim 8, wherein said tube further has external, longitudinal flat surfaces between pairs of said grooves, each said device having a pair of external projections respectively on opposite sides and equidistant from said transverse bore thereof, said projections engaging said flat surfaces for radially orienting said transverse bores to said tube.

10. The projectile according to claim 9, wherein said tube has longitudinal damping ribs defining said flat surfaces.

11. The projectile according to clim 7, wherein said immobilizing means comprise filler elements between said devices and said inner wall of said hollow casing, said elements having different weights for adjusting the overall weight and center of gravity of the projectile.

* * * * *